United States Patent [19]

Thurner

[11] Patent Number: 4,665,785

[45] Date of Patent: May 19, 1987

[54] TRIM PRESS

[75] Inventor: Helmut Thurner, Bavaria, Fed. Rep. of Germany

[73] Assignee: Bayrisches Druckgusswerk Thurner GmbH & Co., Bavaria, Fed. Rep. of Germany

[21] Appl. No.: 788,965

[22] Filed: Oct. 18, 1985

[30] Foreign Application Priority Data

Oct. 26, 1984 [DE] Fed. Rep. of Germany ..... 3439316

[51] Int. Cl.[4] ..... B26D 7/06

[52] U.S. Cl. ..... 83/98; 83/123; 83/157; 83/266; 83/267; 83/914; 164/262

[58] Field of Search ..... 164/262, 265, 269; 83/564, 266, 81, 157, 50, 97, 123, 125, 164, 914, 404.1, 405, 705, 733, 734, 98, 267

[56] References Cited

U.S. PATENT DOCUMENTS 1,205,120 11/1916 Valpey ..... 83/914
3,205,570 9/1965 Morin ..... 164/262
3,785,045 1/1974 Reis ..... 164/262
4,037,731 7/1977 Reis .

FOREIGN PATENT DOCUMENTS 2084907 4/1982 United Kingdom .
821054 4/1981 U.S.S.R. .

*Primary Examiner*—Nicholas P. Godici
*Assistant Examiner*—G. M. Reid
*Attorney, Agent, or Firm*—Dennison, Meserole, Pollack & Scheiner

[57] ABSTRACT

A multiple station sequentially operating trim press is arranged to receive workpieces for subsequent transfer from a loading station to a treatment station by means of a pivotally mounted workpiece support. After trimming and deburring, the workpiece is transferred to a collection station and the workpiece support is moved to a cleaning station where its surface is washed free of residual trimmings. The workpiece support is then returned to its loading station and the sequence repeated.

19 Claims, 3 Drawing Figures

TRIM PRESS

FIELD OF THE INVENTION

The invention relates to a trim press for automatically trimming or deburring die castings or castings.

THE PRIOR ART

DE-PS 30 36 333 No. discloses an apparatus for removing workpieces on a pressure pouring or die casting machine in which a trimming tool consisting of a trimming die and a countermold is disposed on a machine frame for deburring or trimming the workpiece provided with casting or die casting burrs. For this purpose, one of the two halves of the cutting tool is slidably mounted on the machine frame to open the trimming tool. To introduce the workpiece into the opened trimming tool, a workpiece transfer means is provided which has a pivot arm timed to pivot about a pivot axis fixed to the frame. A workpiece holder to receive the casting to be trimmed or deburred is provided at one end of the pivot arm.

With the apparatus previously known, the direction of the trim stroke is horizontal, the transfer means consists of a carrier supported by a horizontal driving shaft, on which there are arranged, offset by 90° each, four cylinder piston units, including piston rods on which there is disposed one transfer arm each for receiving a workpiece. The transfer motion thus takes place on a vertical plane, a pure circular motion, however, being insufficient for receiving and transferring the workpieces into the trim form. Thus, a relatively complex course of motion is employed which, on the one hand, is constituted by a multiple linear movement of the cylinder piston units and, on the other hand, by a sliding movement of the carrier, coordinated to the rotary movement, on the driving shaft. The known apparatus is not only structurally complex but the arrangement of the workpieces on relatively thin, long piston rods renders a transfer of heavy castings by the transfer means almost impossible. This is further complicated since the prior art castings are fixed by bridges joined by the piston rods of the transfer means whose inherent rigidity, particularly in the hot state, does not sustain high bending moments, thus, the need for much heavier molds. Finally, in accordance with the prior art, it is necessary to position the deburring machine directly adjacent the mold and this is not always necessarily desirable for intraplant reasons or space allocation.

BRIEF SUMMARY OF THE INVENTION

The object underlying the present invention is to create a trim press suited to treat castings of both a simple and robust construction and wherein the workpiece transfer means provides an exact feed of the workpiece to the press as well as a separation of the deburred castings from the trimmed waste parts in a relatively simple mode by relatively simply courses of motion.

DETAILED DESCRIPTION OF THE INVENTION

The present invention makes advantageous use of the feature that the workpiece holder for transferring the casting into the trim position is formed by the portion of the trimming die which is rigidly fixed at a constant distance from the pivot axis on the end of the pivot arm, thus following a generally circular path. Thus, the entire pivot means can be rigidly formed such that even very heavy castings, for example, engine motor blocks and the like, may be transferred from one position into the other without difficulty. By the provision of the pivot motion, it is possible to perform the necessary operations at sequential positions. For example, in a first pivot position, the introduction of the workpiece onto the trimming die is accomplished while in a second pivot position, the actual trimming procedure is performed. In a third pivot position, the trimmed burrs are discharged into a waste collector. The main plane of the workpiece holder most advantageously slopes upwardly in the first position in which the workpiece is being fed. Thus, lateral feeding of the workpiece is possible by the workpiece's own weight and positioning in the trimming die secured without additional holding means. The trimming procedure is carried out by a trimming movement directed vertically from above and relatively high acceleration peaks may be employed within the supporting structure of the machine frame without difficulty. In the third position (discharge position), it is advantageous to pivot the trimming die into a position such that its surface slopes downwardly with the waste falling more or less on its own into the waste collector.

A collecting means is attached to the workpiece holder and projects laterally therefrom. The workpiece holder faces the countermold constituting the tool half containing the deburred workpiece in the first position. The trimming die may then be reloaded and, at the same time, a discharge means disposed in the countermold, separates the trimmed workpiece from the mold and when the workpiece holder pivots into the second position, the trimmed product may be passed on automatically into a product receptacle. For this purpose, the collecting means advantageously is formed as a slide extending approximately horizontally under the countermold in the first position and moves with the workholder to slope downwardly toward the workpiece receptacle in the second position. Thus, the workpiece released from the countermold falls into the collector and slides virtually synchronously with the pivot movement, slightly accelerated by the increasing slope of the collector surface and discharges into the workpiece receptacle.

After the trimming procedure, the blank remains temporarily in the countermold which lifts upwardly from the trimming die and remains there until the trimming die has returned from the third position to the first position. Thereafter, workpiece discharge means in the countermold presses the blank out of the countermold onto the collector lying thereunder for subsequent delivery to the workpiece receptacle.

If the vertical axis of the trimming die aligns with the center of the pivotal axis for the pivot arm, it is insured that during the trimming procedure and the application of the trimming forces, no tilting moments are exerted on the trimmng die and thus on the pivot arm and its driving elements. On the contrary, the trimming forces are directly transferred to the machine frame through the bearings of the pivot axis. This provides not only a load-cushioning function for the machine parts but also achieves accurate trimming results. Due to the arrangement of the countermold, the trim die and the pivot axis, when the pivot arm is in the second position (working position), each is in an aligned superposed vertical orientation.

Between the pivot axis and the trim die, the pivot arm defines a laterally U-shaped or sickle-shaped configuration with the bight of the U extending in the pivot plane. The advantage of this shape is that the pivot arm and the members attached thereto, namely the workpiece holder trim die and the collector, laterally aligns with the frame guide columns, when pivoting into the second position, much like a hook, on which columns the countermold is supported for its vertical trim movement.

To support the pivot arm and its components connected with the workpiece holder and trim die, particularly during the trimming step, a support block engages the underside of the pivot arm in the second pivot position (working position) and provides a direct force transmitting path to the machine frame. The pivot arm thus directly overlies the support block and to insure the most effective transfer of forces through the pivot arm components and onto the support block, the surface of the support block includes an inclined ramp portion.

To move the pivot arm between the first and second positions, a driving cylinder is provided. The piston rod is connected to an extension of the pivot arm projecting beyond the pivot axis. The connection defines a knee action in the first position when the piston rod is extended and the pivot arm is in the first or third position and vertically aligned with the pivot axis in the second position.

To move the pivot arm out of the aligned or "dead center position" on the pivot axis, a gear wheel is fixed to the pivot arm and a rack driven by a secondary driving cylinder meshes peripheraly with the gear wheel. Thus, after the trimming step is completed, transfer of the pivot arm from the second to the third position is initiated.

The members coacting with the trimming die including the countermold, feeding means and product collector, etc. must necessarily be arranged on a generally circular path within the arc of movement of the pivot arm. It is desirable to provide between the first and the second positions a pivot angle of about 50° and between the first and the third positions a pivot angle of about 75°. Such relationships limit the space requirements to accommodate the swinging movement of the pivot arm to one side of the frame. Due to the relatively large pivot angle between the first and the third positions, the workholding surface of the trimming die is directed generally downwardly in the third position and thus the trimmed waste parts collected thereon tend to fall free of the die without difficulty.

Preferably, the workpiece feeding device is formed as a conveying stemple linearly directed toward the pivot axis and its front face carries the workpiece to be fed to the workholder. The sliding movement of the stemple describes an angle of about 50° with the direction of the trim stroke such that the workpiece is properly placed in the trim die when the pivot arm and die are in the first position.

To clean the surface of the trim die in the third position for the removal of residual trim cuttings and the like, one may provide spraying means for cleaner and or lubricant under pressure onto the surface, simultaneously cleaning and pre-lubricating the die preparatory for the next trimming procedure.

BRIEF DESCRIPTION OF THE DRAWINGS

The invention is explained in detail by the aid of an example of embodiment in the figures of the drawings.

DETAILED DESCRIPTION OF THE PREFERRED EMBODIMENT

Figure 1:
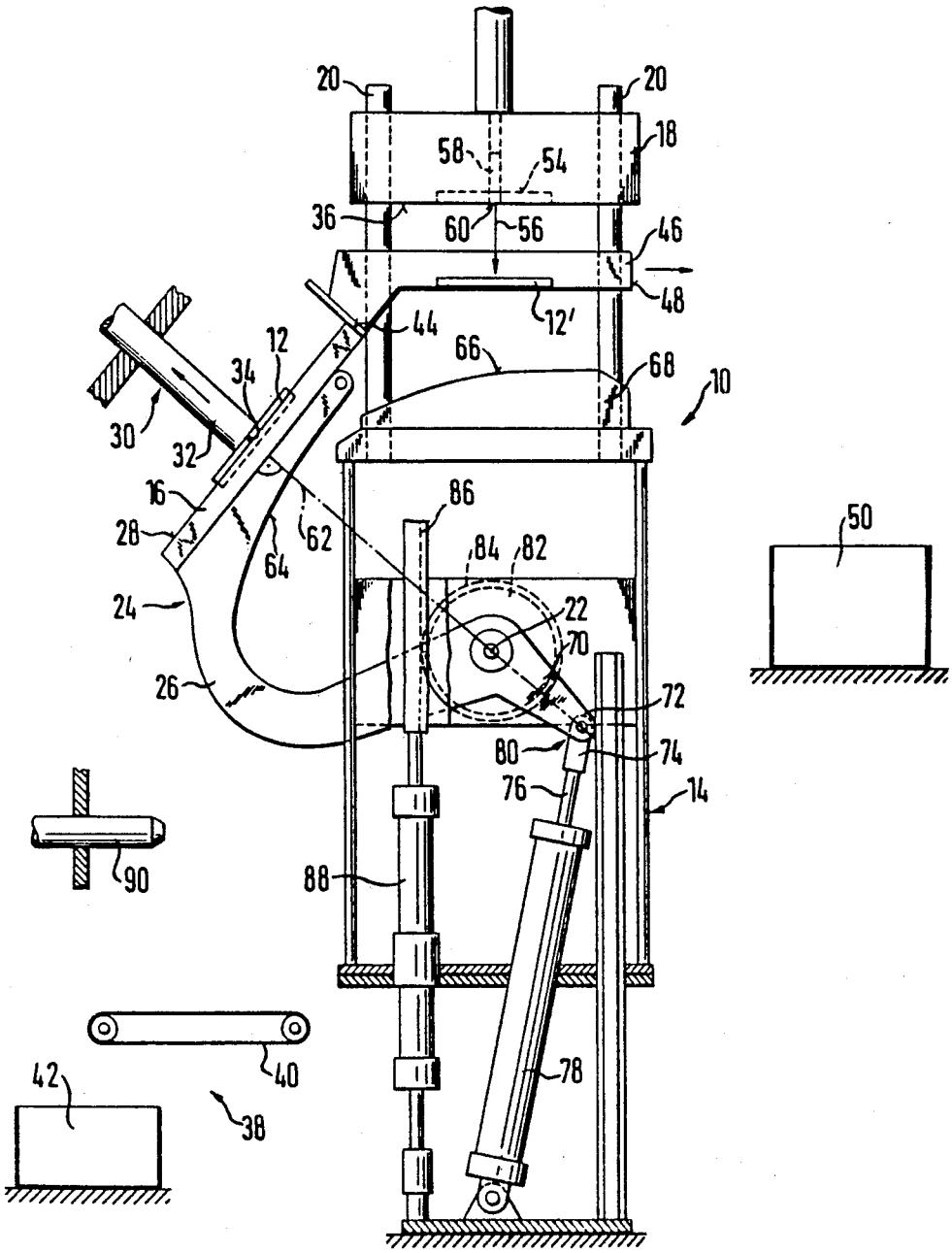
FIG. 1 shows a schematic elevational view of the trim press in the first position (receiving position)

A trim press 10 for the automatic deburring of die castings or castings 12, 12' consists of a machine frame 14 on which there are disposed two selectively coacting cutting tool halves including a trimming die 16 and countermold 18. The countermold 18 is slidable along vertically positioned guide struts 20 between open and closed positions. The machine frame 14 includes a pivotally mounted arm acting as a transfer device designated generally at 24, turning about a fixed pivot axis 22. A workpiece holder 28 is carried by one end of the pivot arm 26 to receive and support a casting 12 to be deburred. The workpiece holder includes a trim die 16 and is movable with pivot arm 26 between three positions. The trim die 16 is fixedly spaced from pivot axis 22 and the die main plane lying always is paralel to pivot axis 22.

In the first position shown in FIG. 1 (receiving position), workpiece holder 28 of the trim die 16 is directed toward a workpiece feeding means 30 formed as a conveying stemple 32 directed toward pivot axis 22. Said stemple carries the casting 12 on its front face 34 for delivey to the workpiece holder 28.

Figure 2:
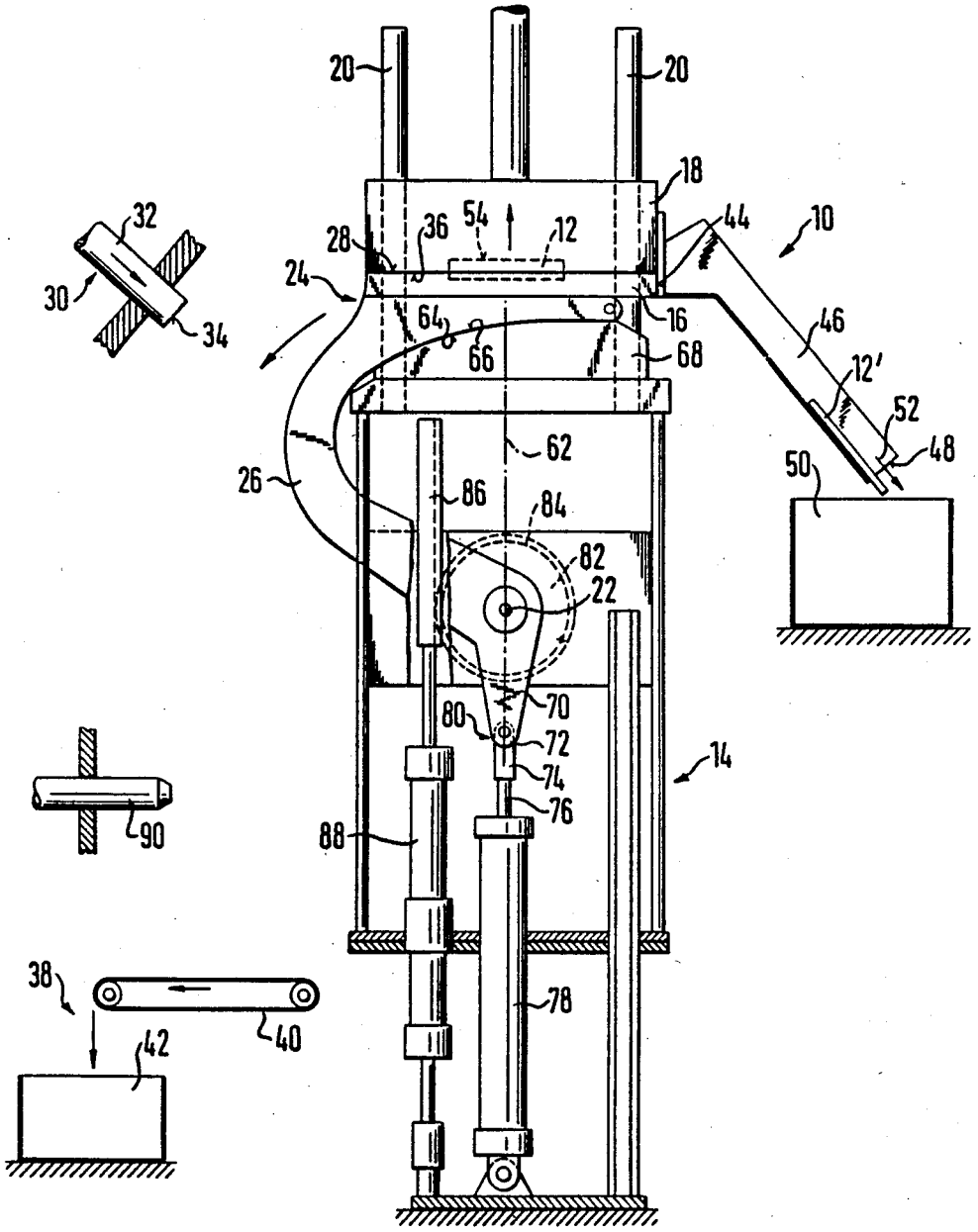
FIG. 2 is a schematic elevational view of the trim press in the second position (trimming position)
Figure 3:
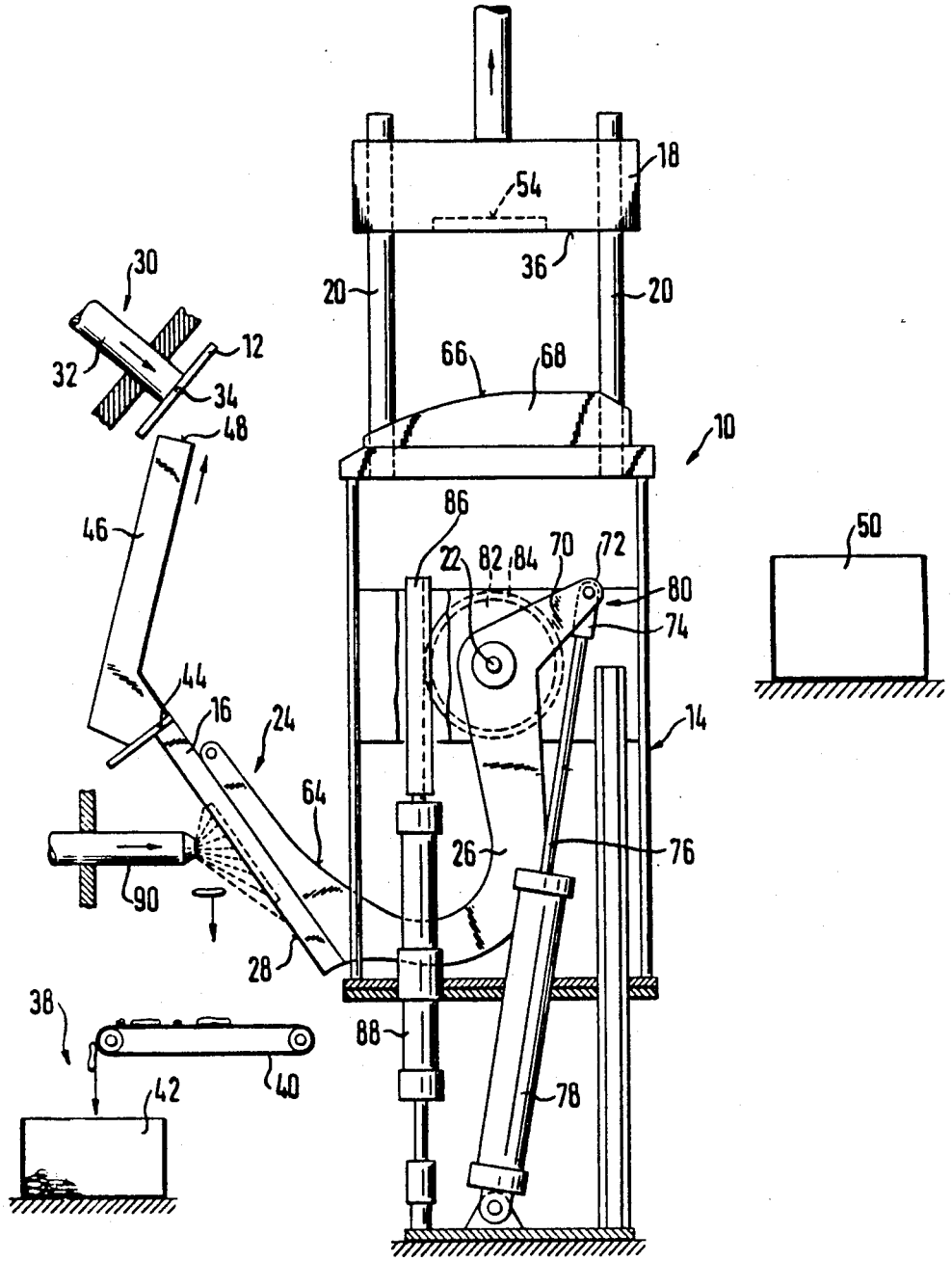
FIG. 3 is a schematic elevational view of the trim press in the third position (ejecting position).

In the second position shown in FIG. 2 (trim position), the pivot arm and the workpiece holder 28 of trim die 16 carried thereon together with the casting to be trimmed are rotated about the pivot 22 to a position parallel to the bottom side 36 of countermold 18. In the third position (ejecting position of FIG. 3), pivot arm 24 and workpiece holder 28 are rotatably directed toward a waste collector 38 including conveyor belt 40 as well as a waste basket 42. Thus, as seen in FIGS. 1, 2 and 3 of the drawings, workpiece holder 28 of the trim die 16 is inclined upwardly in the first position extends horizontally in the second position and is angularly downwardly directed in the third position. The entire arc of movement of pivot arm 26 and of trim die 16 affixed thereto takes place essentially in the space on the left side of pivot axis 22 in the sample of the illustrated embodiment. The feeding means 30 and the waste collector 38 are both disposed on the same side of or on machine frame 14.

On one edge 44 of workpiece holder 28, product collecting means 46 is positioned and is formed essentially as a slide extending approximately horizontally in the first position and is sloping downwardly in the second position. The lower end 48 of the collecting means in the second position of FIG. 2 is adjacent a product collector 50 formed as a basket to receive the trimmed castings 12' deposited on collector 46 in the first position, which slide after deposit in workpiece collector 50 in the direction of arrow 52 in the second position As evident from FIG. 1, the trim mold 18 moves vertically between closed trimming and open non-trimming positions along the guide struts 20. When moved to the open position, the countermold 18 lifts from the trim die 16. The casting 12' is initially retained by friction fit in a die recess 54. To release the casting from said die and to eject it onto the receiving means 46, an ejector in the form of punch 58 is slidably provided in countermold 18. The punch includes a lower front surface 60 which engages the workpiece 12' and presses it out of the countermold.

The vertical centerline 62 of trim die 16 is perpendicular to the center of pivot axis 22 and coaxial with the trimming direction 56 in the second position.

Between pivot axis 22 and trim die 16, the pivot arm 26 is generally U-shaped in the pivot plane (paper plane of the drawing figures) and thus, the upper part of pivot arm 26 carrying the trim die 16 and the collecting means 46 can enter between the guide struts 20 when pivoting into the second position. The underside of the pivot arm underlying the workpiece holder is contoured as at 64. A correspondingly contoured surface 66 of a support block 68 engages the underside 64 of the pivot arm and provides a rigid support for the trimming operation when trimming pressures are applied. The cooperating contoured surfaces may include a planar portion between inner contour 64 and surface 66.

Pivot arm 26 is provided with an extension 70 which at its extremity 72 is pivotally connected by a joint with the driving end 74 of piston rod 76 of a first driving cylinder 78, the piston rod 76 and extension 70 forming the legs of a knee joint 80. In the second position, knee joint 80 is aligned with the longitudinal axes of extension 70 and of driving cylinder 78 in alignment with trim direction 56 and the vertical centerline 62.

To move pivot arm 26 along with the members arranged thereupon from the second position into the first or third position, a pinion gear wheel 82 is arranged on pivot axis 22 and coupled to pivot arm 26. A rack 86 driven by a second driving cylinder 88 engages the pinion 82. Shifting movement of rack 86 is controlled by an incrementally operating linear transmitter (not shown) to control the exact position of the pivot arm in the three positions and may be controlled by a stored-program control and computer, if desired.

A sprayer 90 may be used to spray a combination cleaning, cooling and lubricating agent under pressure onto the surface 28 of trim die 16 when it is pointing downwardly in the third position as best seen in FIG. 3 of the drawings and thus insures that waste chips are removed thoroughly from the trim die between each operational sequence.

OPERATIONAL SEQUENCE

Considering now the operational sequence of the device, it will be recognized that there are generally three primary positions. These are referred to as first, second and third positions. The first position is illustrated in FIG. 1. In this position, the trim die 16 and workpiece holder 28 are directed against feeding means 30 whose conveying stemple 32 introduces workpiece casting 12 to the holder 28. Simultaneously, punch 58 in countermold 18 presses casting 12' deburred during the preceding trimming procedure out of countermold 18 and it is deposited on receiving means 46. Pivot arm 26 along with the members mounted thereupon now pivots into the second position.

The second position is illustrated in FIG. 2. In this position, countermold 28 is moved downwardly against the work holder 28 and trim die 16, deburring casting 12 by this action while simultaneously, the collecting means 46 slopes downwardly and casting 12' previously deposited therein moves by gravity into product collector 50. Casting 12 is now deburred by the action of the die 16 and countermold 18. Die 54 lifts upwardly in the direction of the arrow and carries the trimmed casting therewith. Trim die 16 is thus free for being pivoted into the third position.

The third position is illustrated in FIG. 3. In this position, the chips, burrs, lugs and the like left in the cavities and recesses of the trim die 16 fall onto the conveying belt 40 and are transferred into waste receptacle 42. Spraying means 90 is activated and washes out any remaining chips from trim die 16. The press is then returned to the first position of FIG. 1 where it is supplied with a new casting, as been described above, and the casting already deburred is deposited in the receiving means and the sequence is repeated.

I claim:

1. In a trim press for automatic and sequential trimming and deburring of catings, said trim press including a machine frame, a trimming tool consisting of two coacting tool halves, of which a first tool half reciprocates with respect to a second tool half to define open and closed positions of said tool, the combination comprising:

a workpiece transfer means pivotally movable between a plurality of positions, said work transfer means including a pivot arm carried by said frame and pivotally mounted on a fixed pivot axis on said frame, a workpiece holder including a planar upper surface supporting said other tool half mounted on one end of said arm configured to receive and support a casting thereon to be trimmed or deburred and to transfer said casting from a receiving station to a trimming station and to discharge said casting from said trimming station to a collection receptacle, when said trimming action is completed, said pivot arm being configured to support said workpiece holder in a plane lying parallel to said pivot axis and movable between a loading-unloading position, a trimming-discharging position, and a cleaning position in each sequence.

2. The apparatus according to claim 1 wherein the planar surface (28) of the workpiece holder (16) extends perpendicularly with respect to the vertical centerline in said trimming position, slopes upwardly in a direction toward said centerline in said receiving position, and slopes downwardly in a direction toward said centerline in said cleaning position.

3. The apparatus according to claim 1 wherein the workpiece holder (16) includes a product collecting means (46) carried thereby and movable therewith positioned beneath the first tool half (18) containing the casting (12') from the trimming position.

4. The apparatus according to claim 3 wherein the product collecting means (46) is configured to define a slide extending approximately perpendicularly with respect to said centerline in the receiving position and slopes downwardly away from said centerline in the trimming position, and wherein the lower end of said workpiece collecting means is directed toward a workpiece collector (50).

5. The apparatus according to claim 1 wherein the first tool half (18) includes a workpiece ejecting means (58) activated in the receiving position.

6. The apparatus according to claim 1 wherein the central vertical axis (62) of second tool half (16) extends through pivot axis (22).

7. The apparatus according to claim 1 wherein the direction of movement of one of said tool halves in the trimming direction (56) extends above and perpendicular to the pivot axis (22).

8. The apparatus according to claim 1 wherein the pivot arm is generally U-shaped in a swivel plane between the pivot axis and the trim die.

9. The apparatus according to claim 1 wherein said frame includes a support block (68) and in the trimming-discharge position, said second tool half (16) lies proximate to said support block (68) with said pivot arm (26) engaging and overlying said support block (68).

10. The apparatus according to claim 9 wherein the surface (66) of said support block (68) includes an inclined portion extending toward said pivot arm and wherein upon reaching the trimming-discharge position, the correspondingly shaped underside of said pivot arm is positioned on and is complementary to said support block (68).

11. The apparatus according to claim 1 wherein said pivot arm (26) includes an extension portion extending byond the pivot axis and connected with the end (74) of piston rod (76) extending from a first driving cylinder (78).

12. The apparatus according to claim 11 wherein the longitudinal axis of said extension (70) of said pivot arm extends in the direction of one of the tool halves in the trimming position.

13. The apparatus according to claim 11 wherein a knee joint is formed between the piston rod (76) of the first driving cylinder (78) and extension (70) of pivot arm (26) assumes an extended aligned relationship with the central vertical axis in said trimming-discharge position.

14. The apparatus according to claim 11 wherein pivot axis (22) includes a pinion gear (82) coupled to said pivot arm (26) and a rack driven by a second driving cylinder in mesh therewith.

15. The apparatus according to claim 1 wherein the longitudinal axis of the pivot arm between said loading-unloading and said trimming-discharge positions describes an arc of about 50° and between the loading-unloading and the cleaning positions, an arc of about 75°.

16. The apparatus according to claim 1 wherein a workpiece feeding means (30) includes a conveying stemple (32) linearly slidable toward said pivot axis (22), and supports the casting (12) to be treated.

17. The apparatus according to claim 1 wherein the angular relationship of the feeding means (30) with respect to the central vertical axis defines an angle of abut 50°.

18. The apparatus according to claim 1 wherein the planar upper surface (28) is moved to a stationary spraying means in the cleaning position.

19. A trim press for the automatic trimming or deburring of castings, said trim press including a machine frame (14), a trimming tool consisting of two coacting tool halves of which one tool half (18) reciprocates with respect to the other tool half to define open and closed positions of said tool, a workpiece transfer means including a pivot arm carried by said frame and pivoted about a fixed axis thereon, a workpiece holder configured to receive the other tool half and a casting (12) to be trimmed or deburred, the combination comprising a workpiece holder and tool half carried by said pivot arm for transferring the casting (12) from a loading station to a trimming station, said pivot arm being movable between stations at a constant distance from the pivot axis (22), said arm being movable sequentially from a workpiece receiving station to a workpiece trimming station and sequentially to a workpiece discharging station where the waste material generated by said trimming action is directed to a waste collector (38).

* * * * *